United States Patent [19]

Davies et al.

[11] 4,126,021

[45] Nov. 21, 1978

[54] DUST EXTRACTION ARRANGEMENT FOR AN AUTOMATIC ROUGHING MACHINE

[75] Inventors: John Davies, Syston; Shirley L. W. Fudger, Groby, both of England

[73] Assignee: USM Corporation, Farmington, Conn.

[21] Appl. No.: 827,071

[22] Filed: Aug. 23, 1977

[30] Foreign Application Priority Data

Aug. 24, 1976 [GB] United Kingdom ..... 35174/76

[51] Int. Cl.[2] ..... C14B 1/44; A43D 0/0

[52] U.S. Cl. ..... 69/6.5; 12/1 R

[58] Field of Search ..... 69/6.5; 12/1 R, 77, 12/17.2

[56] References Cited

U.S. PATENT DOCUMENTS 3,831,405 8/1974 Vornberger ..... 69/6.5 X 3,843,985 10/1974 Leonhardt ..... 12/77 X

*Primary Examiner*—Patrick D. Lawson

*Attorney, Agent, or Firm*—Donald N. Halgren; Richard B. Megley; Vincent A. White

[57] ABSTRACT

A dust extraction hood is mounted for pivotal movement with its associated tool on an automatic shoe bottom roughing machine. A parallel linkage is arranged to permit the hood to be spaced equidistantly from the shoe bottom throughout the operation of the machine, or in a way in which the tool becomes retracted into the hood during upward movement thereof. The retraction can be so arranged where maximum clearance is required, that the tool can protrude from the hood, and as the clearance requirements decrease, the hood member can shroud a greater area of the operating surface of the tool.

4 Claims, 2 Drawing Figures

DUST EXTRACTION ARRANGEMENT FOR AN AUTOMATIC ROUGHING MACHINE

BACKGROUND OF THE INVENTION

1. Field of the Invention

This invention relates to shoe machines, and more particularly to shoe bottom roughing machines having dust extraction features.

2. Prior Art

In the manufacture of shoes in which an outsole is cemented directly to the margin of an upper, it is necessary to perform a roughing operation. The roughing operation is necessary to produce a smooth, continuous sole attaching surface by removal of pleats, bulges or irregularities from the overlasted margin. Roughing of the grain side of the margin is also necessary to permit the cement to adhere securely thereto.

Usually in a roughing machine as referred to above, a dust extraction means is provided comprising, for each tool, a hood member within which a tool can be accommodated. The tool has an operating surface portion thereof exposed. Furthermore, the tool supporting means is usually so arranged as to enable a tool or tools supported thereby to follow the heightwise contour of the bottom of a shoe being operated upon, each tool being mounted for movement heightwise of the shoe support as relative movement takes place between the shoe support and the tool supporting means. In such a machine, it is preferable to maintain each hood member in a most effective condition, wherein each hood is mounted for movement heightwise of the shoe support together with each tool.

Usually, each tool is mounted for pivotal movement about a horizontal axis. Such axis may extend generally parallel, to the axis about which the tool can be mounted for rotation, or may alternatively extend generally normally to such axis. In such a case, the hood member for each tool may also be mounted on the axis about which the tool support is mounted for pivotal movement. Where, however, the bottom of a high-heeled shoe is being operated upon, that is a shoe with a pronounced heightwise contour, it can be seen that by pivoting both the hood member and the tool support about the same axis, the hood member is likely, as the tool is being moved upwardly, to be raised to a greater extent in the region thereof away from the pivot, with a result that it may be moved out of its most effective condition in relation to the operating surface portion of the tool.

It is an object of the present invention, to provide a shoe bottom roughing machine which will, especially when operating on the bottoms of high-heeled shoes, as the tool operates "uphill" and "downhill" progressively along marginal portions of the shoe bottom, ensure that adequate clearance is achieved between the hood member associated with each tool and the shoe bottom.

It is a further object of the present invention to provide an improved apparatus suitable for use in performing a roughing operation on marginal portions of shoe bottoms, in which apparatus an effective dust extraction means can be provided.

BRIEF SUMMARY OF THE INVENTION

The present invention comprises a portion of a machine for performing a roughing operation on marginal portions of shoe bottoms. The machine includes a shoe support for supporting a last carrying a shoe, tool supporting means for supporting a rotary roughing tool, and means for effecting relative movement between the shoe support and the tool supporting means. A tool supported by the tool supporting means is caused to operate progressively along a marginal portion of the bottom of a shoe supported by the shoe support. The tool supporting means comprises a tool support mounted on a carrier for pivotal movement relative thereto, about an axis extending parallel, or substantially parallel, to the axis about which a rotatable tool can be mounted. A tool supported by the tool support can be moved heightwise of the shoe support. The machine further comprises a dust extraction hood member within which the rotary tool can be accommodated. The hood member is supported by the tool support, for pivotal movement relative thereto, at a first point spaced from the axis about which said tool support can be pivoted, and is further supported by a lever member, one end of which is pivotally secured to the hood member at a second point, the other end of the lever being pivotally mounted on a portion of the carrier. The distance between said first and second points is the same, or substantially the same, as the distance between said axis and the pivotal mounting of the lever member. Also the distance between the first point and said axis is the same, or substantially the same, as the distance between the second point and said pivotal mounting.

It will thus be appreciated that, with the hood member mounted by a parallel linkage arrangement, the movement of the hood member as the tool is moved heightwise, can take place without its angle of inclination to the shoe bottom being varied. In this manner, the disadvantage of mounting the hood member for pivotal movement about the axis about which the tool support pivots, is overcome.

To maintain the hood member in the same relationship with the operating surface portion of the tool during heightwise movement of the latter, the first point is preferably arranged to be coincident with the axis of rotation of the tool. Operating on the bottoms of high-heeled shoes, however, where clearance between the hood member and the shoe bottom may otherwise give rise to problems, an advantage is to be gained by so arranging the hood member, that the tool, as it progresses "uphill" in effect withdraws into the hood member. The upward movement of the tool is at a greater rate than the corresponding upward movement of the hood member, so that, as the tool moves away from the portions of the shoe bottom where maximum clearance is required, the hood member shrouds a greater area of the tool. An apparatus in which a dust extraction means in accordance with the present invention can be incorporated is described in our co-pending patent application of Messrs. Tutt and Willbond entitled Low Inertia Shoe Machine Tool Support. Where the hood member is used with drive means as above described, including an endless drive member, said hood member may incorporate also a guard for such drive member.

BRIEF DESCRIPTION OF THE DRAWINGS

The objects and advantages of the present invention will become more apparent when viewed in conjunction with the following drawings, in which.

DESCRIPTION OF THE PREFERRED EMBODIMENTS

Figure 1:
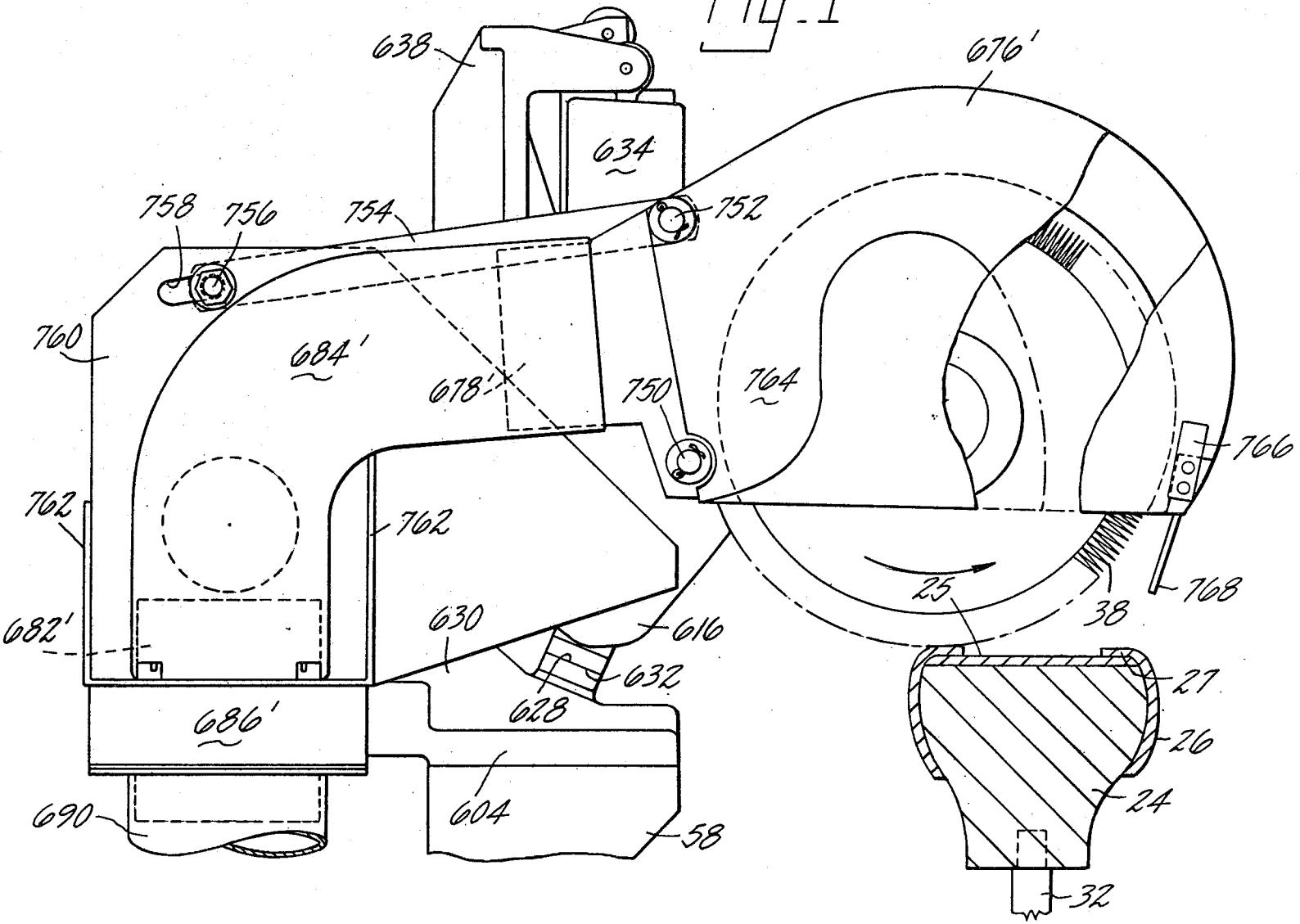
FIG. 1 is a fragmentary end view of a machine constructed according to the principles of the present invention, showing dust extraction means thereof.
Figure 2:
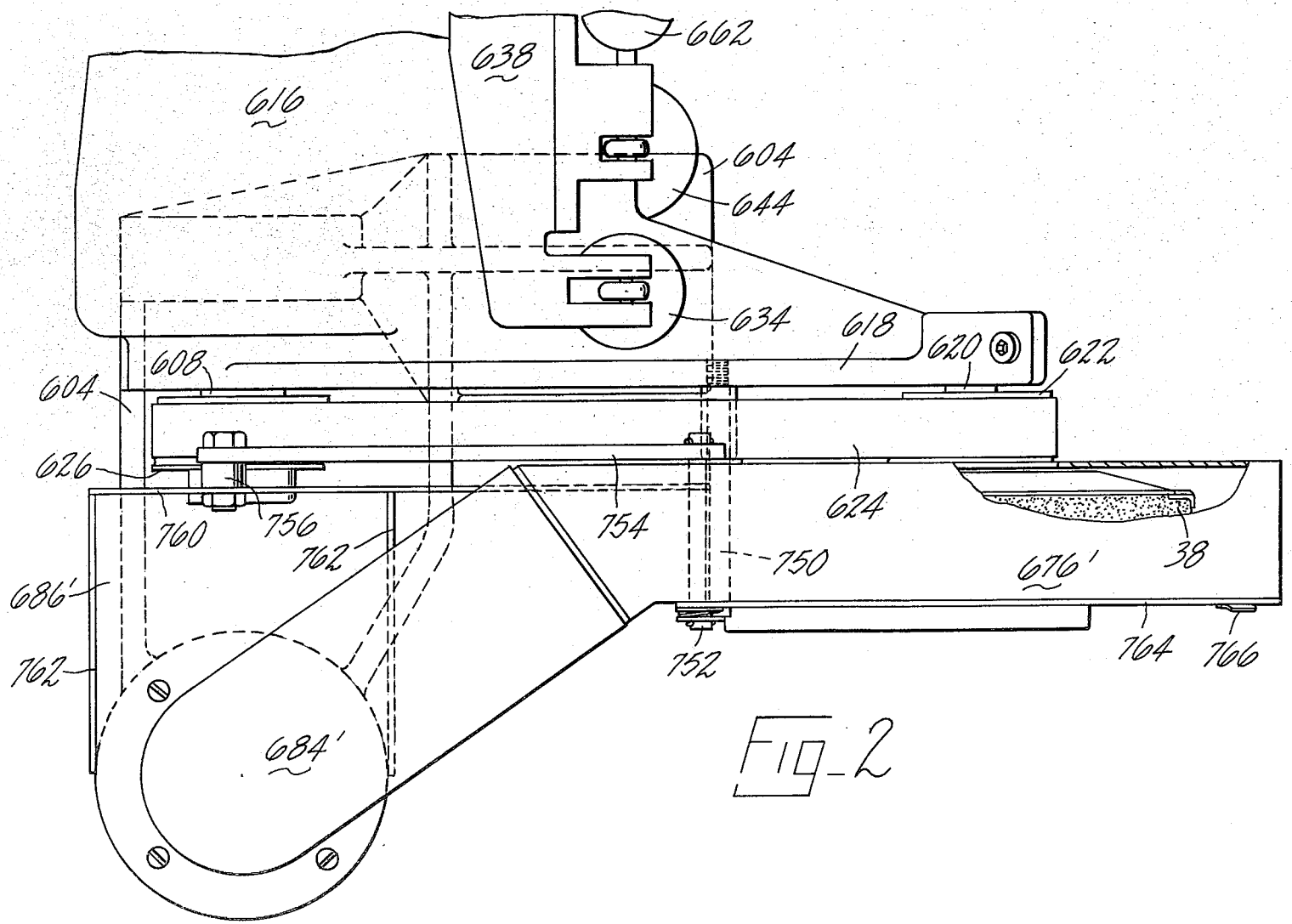
FIG. 2 is a plan view of parts of the apparatus shown in FIG. 1.

The machine comprising the present invention is generally similar, except as hereinafter described, to the apparatus described in the aforementioned co-pending patent application, which is herein incorporated by reference. The machine comprises a frame (not shown) on which a shoe support 32, for supporting, bottom uppermost, a last 24 having an insole 25, located on its bottom, and an upper 26 mounted thereon, having its upper margin 27 secured to the periphery of the insole 25, to be operated upon. The last 24 is mounted for sliding movement along a rectilinear path. The machine also includes tool supporting means for supporting two radial wire brushes 38 (one only shown in the drawings), the brushes being arranged in the path of movement of a shoe supported by the shoe support, one at either side of such path.

The tool supporting means comprises an arrangement of two carrier arms 58 (only one being shown), one arranged at either side of the path of movement of the shoe support. Each carrier arm 58 is mounted for pivotal movement, about a vertical axis, under the control of sensing means (not shown) which cooperates with a template (not shown) mounted for movement together with the shoe support.

Each carrier arm 58 supports a drive shaft 608 which constitutes part of the drive means. Each drive shaft 608 is disposed in bearings carried in brackets (not shown). A motor (not shown) is mounted on each arm 58 and provides rotation of the shaft 608 by means of a belt-and-pulley connection. Each shaft 608 also supports, for limited pivotal movement thereon, a support member 616, which constitutes part of a tool support of the apparatus. Each support member 616 has an inwardly extending arm portion 618 which carries a stub shaft 620 for a toothed drive pulley 622. The stub shaft 620 also supports a brush mounting for the brush 38. The toothed drive pulley 622 is connected by means of a toothed endless belt 624 with a further toothed drive pulley 626 carried on the drive shaft 608. Thus, rotation of each motor causes rotation of the brushes 38.

The operation of the brush 38 upon marginal portions of a shoe bottom, effects an inward wiping action on such marginal portions 27. The rotation of each shaft 608 tends to urge its support member 616 attached thereto to rotate so as to lift the arm portion 618. This upward tendency is countered by the distribution of the weight of the support member 616 and also by the weight of the brush 38 supported thereby.

A stop surface 628 is provided on a work portion 630 of a bracket 604 carried on each arm 58 for determining the lowermost position of the support member 616, and thus of the brush 38 supported thereby, in relation to the arm 58. The stop surface 628 cooperates with a corresponding stop surface 632 provided on the underside of the support member 616.

Various piston and cylinder arrangements are provided, acting between a support member 638 secured to the arm 58 and the support member 616. A first piston and cylinder arrangement 634 when pressurized, urges the support member 616, and thus the brush 38 supported thereby, downwardly. A second, damping, piston and cylinder arrangement 644, acts to damp upward movement of the brush 38. A third piston and cylinder arrangement 662 when pressurized, lifts the tool support, and thus the brush supported thereby, out of operative engagement with the shoe bottom.

The apparatus also comprises, for each tool, dust extraction means comprising a hood 676' having an outlet 678'. The outlet 678' is connected by means of a flexible hose 684' to a hollow boss 682' carried on an extension 686' of the bracket 604. This extension has an aperture formed therein and is aligned with the hollow boss 682', to which a flexible tube 690 can also be connected by which the dust extraction means can be connected to a suction source.

A pin 750, which pivotally supports the hood 676', is carried by the arm portion 618 of the support member 616. A further pivotal connection is made, above the first pin 750, by means of a second pivot pin 752, which is carried at one end of a lever 754. The lever 754 carries a third pivot pin 756 at its other end. The third pivot pin 756 can be clampled captive in an arcuate slot 758 formed in an upstanding support plate 760. The support plate 760 is carried by the extension 686' of the bracket 604. The support plate 760 is provided with an arrangement of two side reinforcing support plates 762.

The center of curvature of the arcuate slot 758 lies coincident with the axis of the shaft 608. Furthermore, the distance between the axis of the shaft 608 and the pin 756 is the same, or substantially the same, as the distance between the first pin 750 (constituting a first pivot point) and the second pin 752 (constituting a second pivot point). Thus, adjustment of the third pin 756 in the arcuate slot 758 will not affect this relationship. Similarly, the distance between the second and third pins 752, 756 is the same, or substantially the same, as the distance between the first pin 750 and the axis of the shaft 608. The hood 676', therefor, is supported by a parallel linkage arrangement.

The first pin 750 lies in a plane in which the axis of the drive shaft 608 and the axis of the stub shaft 620 also lie, the first pin being intermediate said two axes. As the support member 616 is caused to pivot about the axis of the shaft 608, the tool will move upwardly proportionately more quickly than the hood 676', the ratio between the two movements depending upon the position of the pin 750. The initial position of the hood in relation to a shoe bottom is determined by the position of the pin 756 in the arctuate slot 758, The hood 676' can thus be initially positioned appropriately to the shoe bottom to be operated upon, and as the tool 38 follows the heightwise contour of the shoe bottom, the position of the hood will vary in relation to the operating surface portion of the tool, the arrangement being such that the higher the tool moves, the more it will be retracted within the hood 676'.

The hood 676' which is made of sheet metal, is generally shaped to shroud the rotary roughing tool 38. It is provided with a "door" 764 which pivots about the second pin 752, a spring catch 766 being provided for holding the door in position. Furthermore, a flap 768 of flexible material, e.g. leather, is provided which depends from the wall of the hood member remote from the first pivot pin 750. Since the brush 38 effects an inward wiping action on the shoe bottom, and thus rotates in the direction of the arrow shown in FIG. 1, the flap member 768 is effective to catch any particles of dust which are thrown in a low tangential path from the operating surface of the brush at the point of contact with the shoe bottom thereof. Furthermore, because the material is flexible, no damage will be done by the flap 768 engaging with the bottom of the shoe.

Having thus described our invention what we claim as new and desire to secure as Letters Patent of the U.S. is:

1. A machine for roughing the margin of an upper of a shoe assembly mounted on a movable shoe assembly support, said shoe assembly including a last having an insole located on its bottom and an upper mounted thereon having its margin secured to the periphery of the insole, said machine comprising:

tool supporting means for supporting the rotary roughing tool;

means for effecting relative movement between said shoe support and said tool supporting means whereby a tool supported by the tool supporting means is caused to operate progressively along a marginal portion of the bottom of a shoe supported by the shoe support;

said tool supporting means comprising a tool support mounted on a carrier for pivotal movement relative thereto about an axis extending generally parallel to the axis of rotation of said tool whereby a tool supported by the tool support can be moved heightwise of said shoe support; and dust extraction means comprising a hood member wherein said tool is arranged therein having an exposed operating surface, said hood being mounted for proportional movement heightwise of said shoe support with respect to the heightwise movement of said tool, and said hood member being supported by said tool support for pivotal movement relative thereto.

2. A machine for roughing the margin of an upper of a shoe assembly as recited in claim 1, wherein said hood is pivotally supported by said tool support at a first point spaced from said axis about which said tool support can be pivoted;

said hood being also supported by a lever member, one end of which is pivotally secured to said hood member at a second point, the other end of said lever being pivotally mounted on a portion of said carrier.

3. A machine for roughing the margin of an upper of a shoe assembly as recited in claim 2, wherein the distance between said first and second points is generally the same as the distance between said axis and the pivotal mounting of said lever member;

the distance between the first point and said axis being generally the same as the distance between the second point and said pivotal mounting.

4. A machine for roughing the margin of an upper of a shoe assembly as recited in claim 2, wherein said end of lever mounted on a portion of said carrier is slidingly disposed in an arcuate slot.

* * * * *